US008408961B2

(12) United States Patent
Becker et al.

(10) Patent No.: US 8,408,961 B2
(45) Date of Patent: Apr. 2, 2013

(54) METHOD FOR PRODUCING A MOLYBDENUM FILM FOR THE CONSTRUCTION OF A LAMP AND MOLYBDENUM FILM AND LAMP WITH MOLYBDENUM FILM

(75) Inventors: Jürgen Becker, Berlin (DE); Detlef Günther, Berlin (DE); Andreas Naujoks, Birkenwerder (DE); Andreas Ponnier, Berlin (DE); Lothar Vollmer, Berlin (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 0 days.

(21) Appl. No.: 12/597,757

(22) PCT Filed: Apr. 24, 2008

(86) PCT No.: PCT/EP2008/054978

§ 371 (c)(1),
(2), (4) Date: Dec. 10, 2009

(87) PCT Pub. No.: WO2008/132123

PCT Pub. Date: Nov. 6, 2008

(65) Prior Publication Data

US 2010/0127610 A1 May 27, 2010

(30) Foreign Application Priority Data

Apr. 27, 2007 (DE) ..... 10 2007 020 067

(51) Int. Cl.
*H01J 1/96* (2006.01)
*B24C 1/00* (2006.01)

(52) U.S. Cl. ..... 445/58; 313/284; 451/38

(58) Field of Classification Search ..... 313/284; 445/46, 48, 58; 451/38
See application file for complete search history.

(56) References Cited

U.S. PATENT DOCUMENTS

| | | | | |
|---|---|---|---|---|
| 3,939,613 | A | 2/1976 | Ayers | |
| 4,587,454 | A | 5/1986 | Bonazoli et al. | |
| 6,239,550 | B1 | 5/2001 | Maeda | |
| 6,448,532 | B1 | 9/2002 | Mittler et al. | |
| 6,468,658 | B2 | 10/2002 | Lange et al. | |
| 6,753,650 | B2 | 6/2004 | Leichtfried et al. | |
| 6,815,892 | B2 | 11/2004 | Morimoto et al. | |
| 2002/0023773 | A1 | 2/2002 | Khandros | |
| 2005/0059541 | A1 * | 3/2005 | Hirao et al. | 501/87 |
| 2005/0269299 | A1 | 12/2005 | Rittner | |
| 2007/0035252 | A1 * | 2/2007 | Becker et al. | 313/633 |

FOREIGN PATENT DOCUMENTS

| | | | |
|---|---|---|---|
| DE | 573448 | C | 3/1933 |
| DE | 9015032 | U1 | 1/1991 |
| DE | 19930336 | A1 | 1/2001 |

(Continued)

OTHER PUBLICATIONS

International Search Report issued Jan. 27, 2009.
English language abstract for JP 10-92775 A.
English language abstract for DE 10 2006 038821 A1.

(Continued)

*Primary Examiner* — Karabi Guharay

(57) ABSTRACT

A method for producing a molybdenum film for lamp construction is provided. The method may include roughening at least a part of the surface of the molybdenum film by sandblasting with a sandblasting means, wherein the sandblasting means contains at least one of aluminum oxide and quartz sand as well as at least one further component.

1 Claim, 4 Drawing Sheets

FOREIGN PATENT DOCUMENTS

| | | | |
|---|---|---|---|
| DE | 10337335 | A1 | 3/2005 |
| DE | 102006036576 | A1 | 2/2007 |
| DE | 102006038821 | A1 | 3/2007 |
| EP | 0871202 | A2 | 10/1998 |
| EP | 0884763 | A2 | 12/1998 |
| EP | 1066912 | A1 | 1/2001 |
| EP | 0913855 | B1 | 7/2002 |
| EP | 1164115 | B1 | 6/2004 |
| EP | 1604772 | A1 | 12/2005 |
| EP | 1156505 | B1 | 4/2009 |
| GB | 283848 | A | 5/1928 |
| GB | 396103 | | 7/1933 |
| GB | 474982 | A | 11/1937 |
| JP | 10092775 | A | 4/1998 |
| JP | 10112262 | A | 4/1998 |
| JP | 11047815 | A | 2/1999 |
| JP | 2007026960 | A | 2/2007 |
| WO | 2005025890 | A2 | 3/2005 |

OTHER PUBLICATIONS

English language abstract for DE 103 37 335 A1.
English language abstract for EP 0 884 763 A2.
English translation of DE 9015 032 U1, p. 5, paragraph 2-p. 7, paragraph 2, figures 1-4.
Li et al. "Grit Blast Assisted Laser Milling/Grooving of Metallic Alloys", Cirp Annals, Technische Rundschau, Berne CH, vol. 54, No. 1 Jan. 1, 2005, pp. 183-186.
Kern M. et al. "Sandblasting and silica-coating of dental alloys: volume loss, morphology and changes in the surface composition", Dental Materials, Elsevier, vol. 9, No. 3, May 1, 1993, pp. 155-161.
English language abstract for DE 10 2006 036 576 A1.
English Abstract of JP10112262 A. Apr. 28, 1998.
English Abstract of JP 11047815 A. Feb. 23, 1999.
English Abstract of JP 2007026960 A. Feb. 1, 2007.

* cited by examiner

METHOD FOR PRODUCING A MOLYBDENUM FILM FOR THE CONSTRUCTION OF A LAMP AND MOLYBDENUM FILM AND LAMP WITH MOLYBDENUM FILM

RELATED APPLICATIONS

The present application is a national stage entry according to 35 U.S.C. §371 of PCT application No.: PCT/EP2008/054978 filed on Apr. 24, 2008, which claims priority from German application No.: 10 2007 020 067.8 filed on Apr. 27, 2007.

TECHNICAL FIELD

The invention relates to a method for production of a molybdenum film for lamp construction, according to which at least a part of the surface of the molybdenum film is roughened by sandblasting with a sandblasting means, and to a molybdenum film such as this as well as a lamp having a molybdenum film such as this.

BACKGROUND

Molybdenum films such as these can be embedded in a gas-tight manner in quartz glass vessels, and are therefore used as a component of electrical supplies for light sources which are surrounded in a gas-tight manner by lamp vessels composed of quartz glass. This use of molybdenum films is described, for example, in German patent specification DE 573 448 for molybdenum films with a thickness of less than 20 micrometers, and for example in British patent specification GB 474 982 for thicker molybdenum films. In the following text and for the purposes of the invention described in the following text, the expression molybdenum film means metal films based on molybdenum, which are composed substantially of molybdenum. This means that the expression molybdenum film covers metal films which are composed of molybdenum or of molybdenum provided with additives and/or dopants, wherein the proportion by weight of the additives or dopants is considerably less than the proportion by weight of molybdenum in the metal film. By way of example, the expression molybdenum film also includes a metal film which is composed of molybdenum to which approximately 1 percent by weight of yttrium oxide or yttrium-cerium mixed oxide has been added.

Patent specification U.S. Pat. No. 4,587,454 discloses a method for production of a molybdenum film for lamp construction, according to which the surface of the molybdenum film is roughened by sandblasting in order in this way to prevent discontinuities or cracks in the quartz glass of the lamp vessel surrounding the molybdenum film.

Laid-open specification EP 1 156 505 A1 describes a molybdenum film for use as a component of electrical bushings through lamp vessels, wherein the molybdenum film has essentially non-cohesive, insular areas of substance agglomerates on 5 to 60 percent of its surface area with a surface structure which is different from the raw film and/or material compositions composed of molybdenum or of its alloys, of titanium, of silicon or of an oxide, a mixed oxide and/or of an oxidic compound with a vapor pressure of in each case less than 10 millibars at 2000° C.

Patent specification U.S. Pat. No. 6,815,892 discloses a molybdenum film for lamp construction, whose total surface area is provided with a coating. The coating is composed of a metal oxide from the group consisting of titanium oxide, lanthanum oxide, tantalum oxide, zirconium oxide, yttrium oxide and hafnium oxide.

SUMMARY

Various embodiments provide a method for production of a molybdenum film for lamp construction and a molybdenum film such as this, as well as a lamp having a molybdenum film such as this, which allows better adhesion between the molybdenum film and the lamp vessel material surrounding it.

According to the invention, this object is achieved by the features including: a sandblasting means containing aluminum oxide and/or quartz sand as well as at least one further component; a method, according to which at least a part of the surface of the molybdenum film is roughened by sandblasting with a sandblasting means, wherein the sandblasting means contains at least one of aluminum oxide and quartz sand as well as at least one further component; a molybdenum film for use in lamp construction, wherein the molybdenum film has a surface which is roughened by sandblasting, and particles of the sandblasting means are deposited on the surface of the molybdenum film, wherein the particles of the sandblasting means which are deposited on the surface of the molybdenum film are at least one of aluminum oxide particles and quartz sand particles as well as particles of at least one further component of the sandblasting means; and a lamp having at least one molybdenum film, wherein the molybdenum film has a surface which is roughened by sandblasting, and particles of the sandblasting means are deposited on the surface of the molybdenum film, wherein the particles of the sandblasting means which are deposited on the surface of the molybdenum film are at least one of aluminum oxide particles and quartz sand particles as well as particles of at least one further component of the sandblasting means. Particularly advantageous embodiments of the invention are described in the dependent patent claims.

The method according to the invention for production of a molybdenum film for lamp construction is distinguished in that at least a part of the surface of the molybdenum film, preferably the entire surface of the molybdenum film, is roughened by sandblasting, and the sandblasting means which is used for this purpose contains aluminum oxide and/or quartz sand as well as at least one further component.

The combination according to the invention of aluminum oxide and/or quartz sand as well as the at least one further sandblasting means component achieves better adhesion of the molybdenum film to the lamp vessel material, in particular quartz glass. Experiments have shown that, in the case of high-pressure discharge lamps whose discharge vessel has been sealed with the molybdenum films according to the invention or with the molybdenum films produced using the method according to the invention have a longer life than those high-pressure discharge lamps whose discharge vessel was sealed with molybdenum films sand-blasted in the conventional manner. In particular, in the case of the high-pressure discharge lamps with the molybdenum films according to the invention, that film edge of the quartz glass of the discharge vessel which faces the discharge area was lifted off more rarely than in the case of high-pressure discharge lamps which are equipped with molybdenum films produced in the conventional manner.

The sandblasting according to the invention results in deposits of fine particles of the sandblasting means being formed on the surface of the molybdenum film, that is to say deposits of aluminum oxide particles and/or quartz sand particles, as well as particles of the at least one further sandblasting means component which, together with the roughened surface of the molybdenum film, are responsible for good adhesion between the molybdenum film and the lamp vessel material.

The quantity of the sandblasting means particles which are deposited on the surface of the molybdenum film, distributed homogeneously with a low density per unit area, is not sufficient to form a closed layer or insular agglomerates on the molybdenum film surface. The deposits which are formed in a small amount on the molybdenum film surface by the sandblasting according to the invention have the advantage that they do not impede the welding of the molybdenum film to other electrical supply parts. In particular, the molybdenum film produced using the method according to the invention can be welded with a low contact resistance and in a simple manner to a gas discharge electrode which projects into the discharge area and is composed of tungsten, and to an electrical supply wire which projects out of the discharge vessel, for example by means of resistance welding according to EP 1 066 912 A1 or by means of LASER welding according to EP 1 604 772 A1.

The main component of the sandblasting means is advantageously formed by aluminum oxide or quartz sand, or a mixture of aluminum oxide and quartz sand. This means that aluminum oxide or quartz sand or the mixture composed of aluminum oxide and quartz sand make up the greatest proportion by weight of the sandblasting means. This main component in the sandblasting means is used to roughen the surface of the molybdenum film, and to compress the molybdenum film.

According to the preferred exemplary embodiments of the invention, the proportion by weight of the aluminum oxide and/or of the quartz sand in the sandblasting means is greater than 99 percent by weight, and the proportion by weight of the at least one further component in the sandblasting means is less than 1 percent by weight.

Good results have been achieved using a sandblasting means which is composed of aluminum oxide and/or quartz sand as well as titanium oxide, and in which the proportion by weight of titanium oxide is in the region of 0.1 percent by weight to 0.25 percent by weight.

Instead of titanium oxide, or in addition to titanium oxide, it is also possible to use, as a further component in addition to aluminum oxide and/or quartz sand, one or more oxides from the group consisting of zirconium oxide, hafnium oxide, lanthanum oxide, cerium oxide and tantalum oxide. In addition, instead of using titanium oxide, it is also possible to use ruthenium as a further component in addition to aluminum oxide and/or quartz sand in the sandblasting means.

The particle size of the at least one further component in the sandblasting means is advantageously less than or equal to 1 micrometer in order to ensure sufficiently good adhesion of the particles of the at least one further component to the rough molybdenum film surface. The mean particle size of the main component, which is formed by aluminum oxide and/or quartz sand, of the sandblasting means is advantageously less than or equal to 100 micrometers, in order to achieve the abovementioned roughening of the molybdenum film surface and compression of the molybdenum film.

The molybdenum film according to the invention is preferably suitable as a component of electrical bushings through lamp vessels composed of glass, in particular composed of quartz glass or of a glass with a very high silicon-dioxide content. In particular, the molybdenum film according to the invention is embedded in a gas-tight manner in lamp vessels composed of quartz glass, such that one end of the molybdenum film is connected to an electrical supply wire, which projects out of the lamp vessel, and its other end is connected to an electrode which projects into the interior of the lamp vessel, or to an incandescent filament outlet. The molybdenum film according to the invention therefore ensures that electricity is passed in a gas-tight manner through a lamp vessel composed of quartz glass or of a glass having a very high silicon-dioxide content, usually of more than 95 percent by weight.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
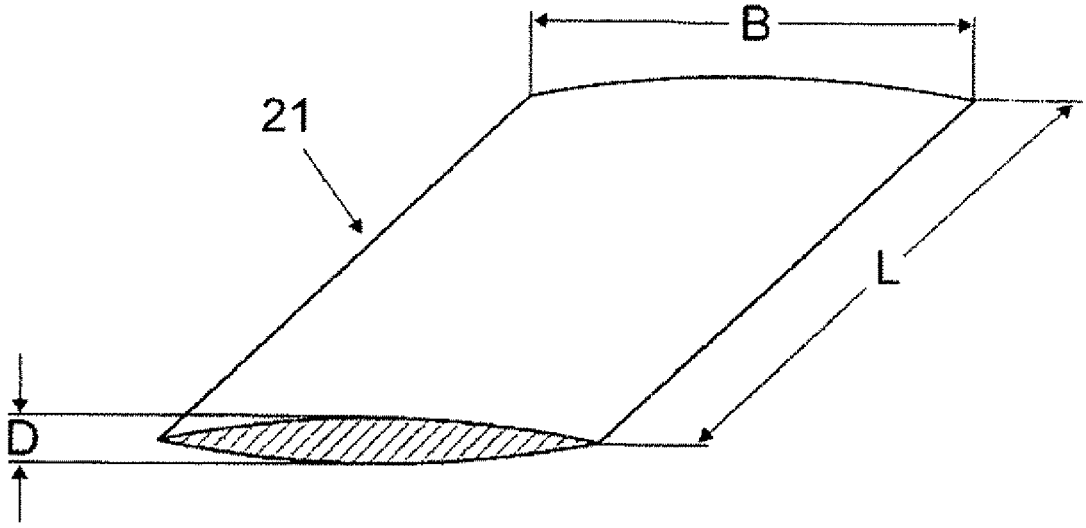
FIG. 1 shows a schematic, partially sectioned illustration of a molybdenum film according to the invention for lamp construction.

FIG. 1 shows a schematic, partially sectioned illustration of a molybdenum film 21 according to the invention. The molybdenum film 21 is curved in the shape of a lens, lancet or cushion. For use as a sealing film in the discharge vessel of a halogen metal-vapor high-pressure discharge lamp with an electrical power consumption of about 35 Watts, this molybdenum film 21 has a maximum thickness D of 25 micrometers. Its length L in the longitudinal extent direction is 6.5 millimeters, and its width B is 2 millimeters. The molybdenum film 21 is normally cut from a molybdenum strip, which is rolled up on a supply wheel. The cut surfaces in this case run at right angles to the longitudinal extent of the molybdenum film 21. In order to reduce the risk of crack formation in the lamp vessel material surrounding the molybdenum film, the cut edges of the molybdenum film 21 can be smoothed or rolled, for example as disclosed in EP 0 884 763 A2.

The molybdenum film 21 according to the invention is produced by means of the known metallurgical annealing processes and sintering processes, as well as rolling processes, from molybdenum powder that is pressed into a mold. Dopants or additives can be added to the molybdenum powder, for example by adding the abovementioned oxides, yttrium oxide, or yttrium-cerium mixed oxide.

The molybdenum film 21 which has been fabricated in this way is, according to the first, particularly preferred exemplary embodiment of the invention, sand-blasted on both sides with a homogeneous mixture of aluminum oxide and titanium oxide, with the proportion by weight of titanium oxide in the sandblasting means being 0.1 percent by weight, and the remainder being aluminum oxide, which is also referred to as corundum. The mean particle size of the aluminum oxide particles is 100 micrometers, and the mean particle size of the titanium oxide particles is 0.5 micrometers.

Figure 5:
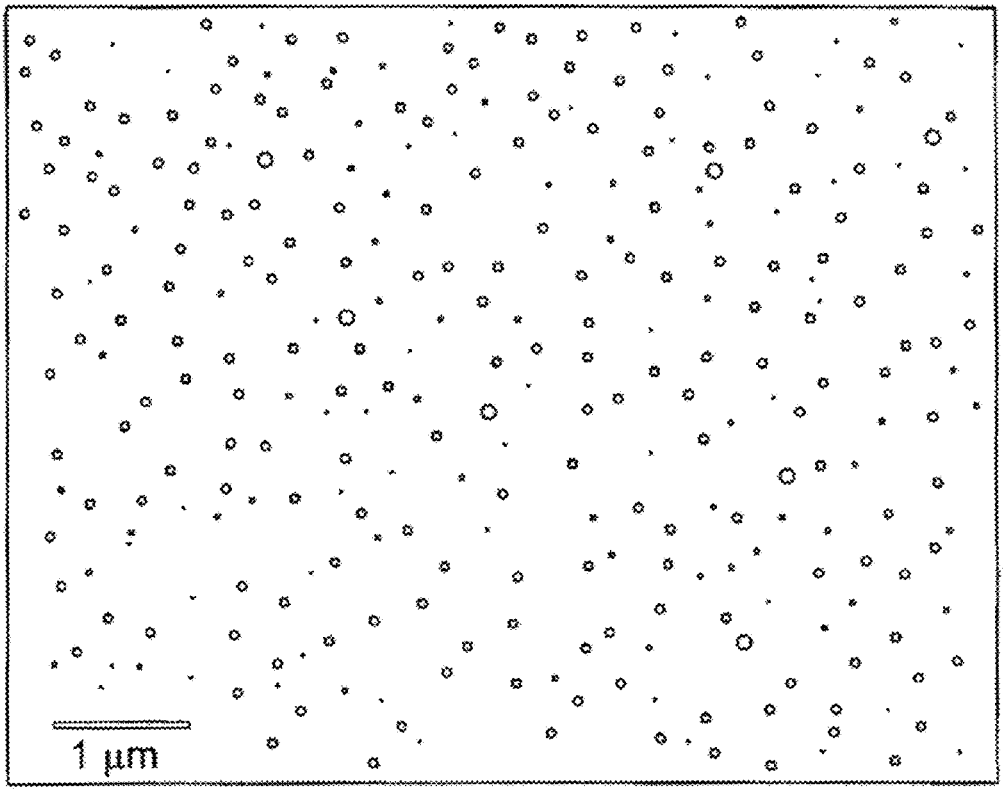
FIG. 5 shows a schematic illustration of the distribution of fine-grain aluminum oxide particles and titanium oxide particles on the surface of the molybdenum film.

It has been found that, after completion of the sandblasting process, fine-grain components of the sandblasting means remain adhered to the surface of the molybdenum film 21. This means that the sandblasting not only roughens the surface of the molybdenum film 21, but also results in deposits of aluminum oxide particles (corundum particles) and titanium oxide particles being formed on the surface of the molybdenum film 21. The surface of the molybdenum film 21 is illustrated schematically in FIG. 5, with an indicated scale (1 μm). Deposits of fine-grain aluminum oxide particles and titanium oxide particles adhere to the molybdenum film surface, distributed homogeneously with a low density per unit area. The finer-grain titanium oxide particles adhere better to the molybdenum film surface than the aluminum oxide particles. The proportion of the titanium oxide particles which adhere to the molybdenum film therefore does not correspond to its mixed ratio in the sandblasting means. In order to determine the amount of aluminum oxide particles and titanium oxide particles adhering to the surface of the molybdenum film 21, a large number of molybdenum films 21 which had been sandblasted according to the invention were dissolved in acid. The analysis resulted in an average weight of the molybdenum film of 22.5 mg/cm$^2$ and an average weight of the aluminum oxide particles adhering to the molybdenum film of 0.247 mg/cm$^2$, as well as an average weight of the titanium oxide particles adhering to the molybdenum film of 0.062 mg/cm$^2$.

According to the second exemplary embodiment of the invention, the molybdenum film 21 is sandblasted on both sides with a homogeneous mixture of aluminum oxide and titanium oxide, with the proportion by weight of titanium oxide in the sandblasting means being 0.25 percent, and the remainder being aluminum oxide. The mean particle size of the corundum particles is 100 micrometers, and the mean particle size of the titanium oxide particles is 0.5 micrometers. An analysis of these molybdenum films resulted in an average weight of the molybdenum film of 18.2 mg/cm$^2$ and an average weight of the aluminum oxide particles adhering to the molybdenum film of 0.197 mg/cm$^2$, as well as an average weight of the titanium oxide particles adhering to the molybdenum film of 0.117 mg/cm$^2$.

Figure 2:
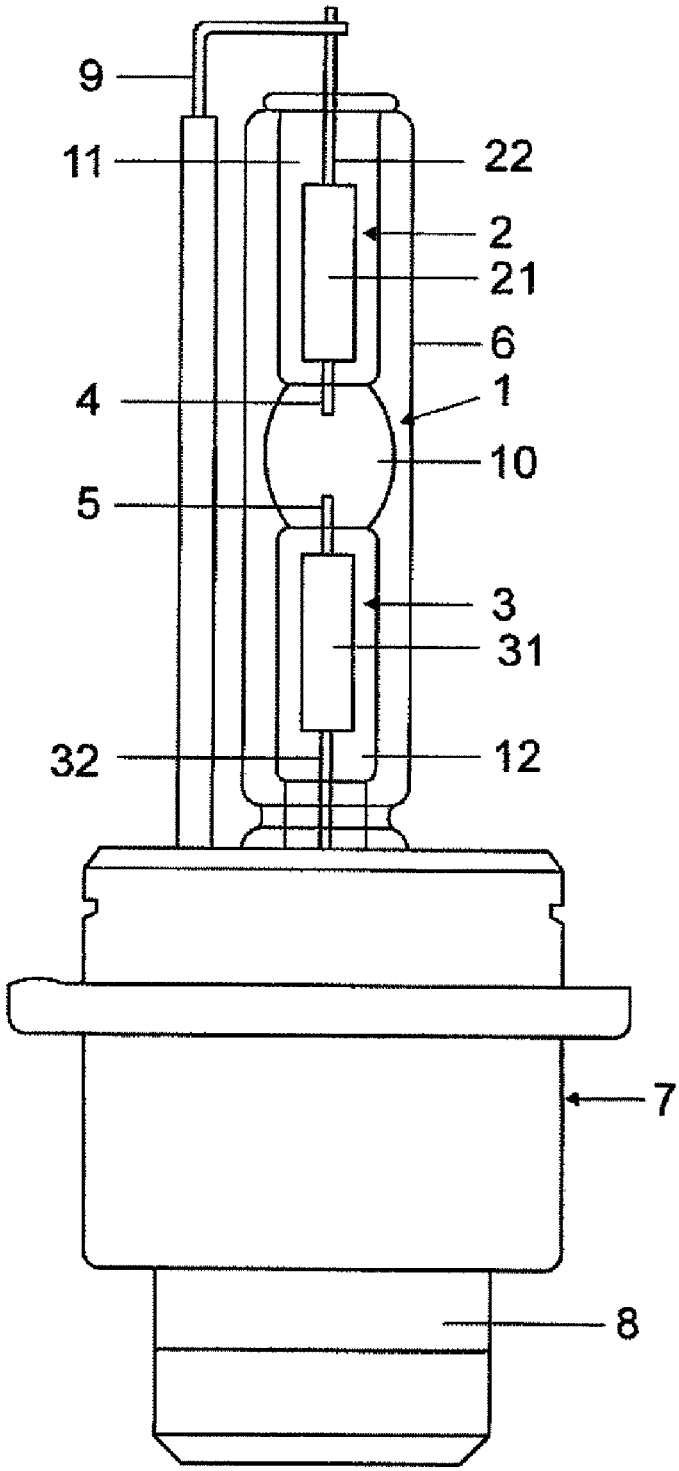
FIG. 2 shows a schematic illustration of a halogen metal-vapor high-pressure discharge lamp according to the invention, having two molybdenum films as shown in FIG. 1.

FIG. 2 shows a halogen metal-vapor high-pressure discharge lamp with an electrical power consumption of about 35 watts. This high-pressure discharge lamp has a discharge vessel 1 composed of quartz glass with an interior 10 and two sealed ends 11, 12, which are arranged diametrically opposite and respectively have an electrical bushing 2, 3. Two electrodes 4, 5 which are arranged diametrically opposite, are respectively connected to one of the electrical bushings 2 or 3 and between which a gas discharge is formed when the lamp is being operated, project into the interior 10. A filling which can be ionized is enclosed in the interior 10 of the discharge vessel 1, composed of xenon and a plurality of metal halides, possibly as well as mercury. The discharge vessel 1 is surrounded by an outer bulb 6 which is composed of quartz glass and is provided with dopants which absorb ultraviolet radiation. The lamp furthermore has a plastic cap 7, which supports the two lamp vessels 1, 6 and is equipped with the electrical connections 8 for the lamp. The electrical bushing 2 of that end 11 of the discharge vessel 1 which is remote from the cap is connected via the electrical return 9 to the first electrical connection 8, while the other electrical bushing 5 is connected to a second electrical connection (not shown) of the lamp. All of the operating equipment for the lamp, or parts of the operating equipment, for example the starting apparatus, can be arranged in the lamp cap 7.

The electrical bushings 2, 3 have a respective molybdenum film 21 or 31, according to the invention which is embedded in a gas-tight manner in the respective end 11 or 12. The molybdenum film 21 or 31 is illustrated schematically in FIG. 1. That side of the respective molybdenum film 21 or 31, which faces away from the interior 10 of the discharge vessel 1 is respectively welded to a molybdenum wire 22 or 32, which projects out of the respective corresponding sealed end 11 or 12. That side of the respective molybdenum film 21 or 31 which faces the interior 10 of the discharge vessel 1 is welded to a respective electrode 4 or 5, which is in the form of a rod, is composed of tungsten, and projects into the discharge area 10.

Figure 3:
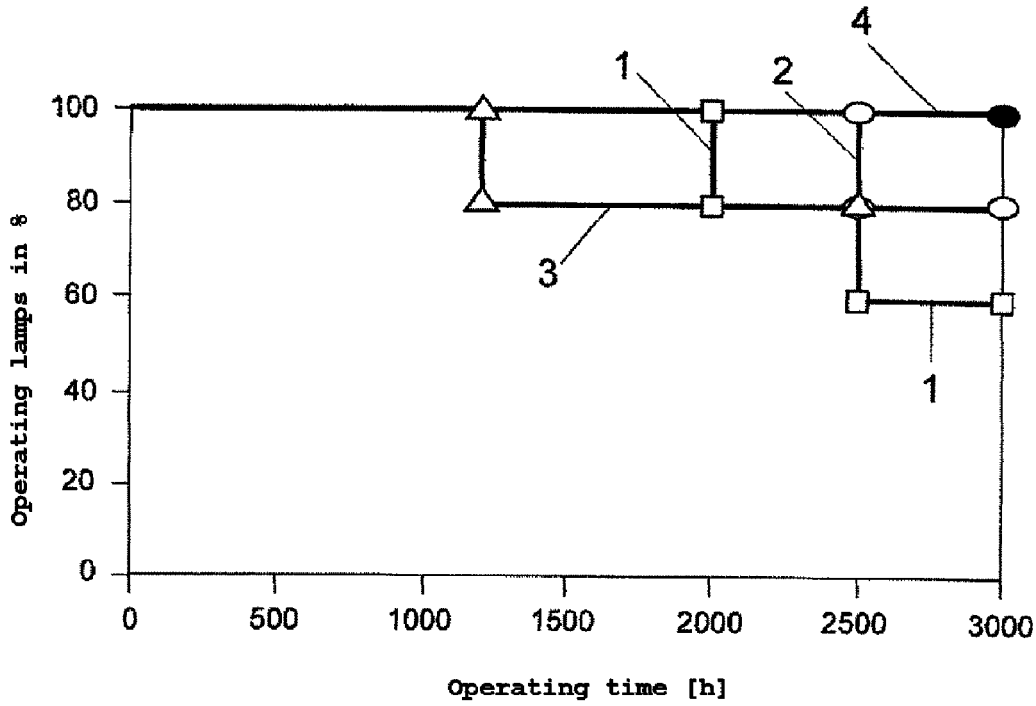
FIG. 3 shows the percentage component of the still functional, tested, halogen metal-vapor high-pressure discharge lamps over the operating time of the high-pressure discharge lamps.

FIG. 3 shows the result of a life measurement on a large number of halogen metal-vapor high-pressure discharge lamps containing mercury, designed according to the example illustrated in FIG. 1, but which were provided with different molybdenum films. The lamps corresponding to the measurement curve 1 in FIG. 3 were provided with molybdenum films which had been sand-blasted according to the prior art. The first of these lamps failed after 2000 operating hours. The lamps corresponding to the measurement curves 2 and 3 in FIG. 3 were provided with molybdenum films which have a coating according to EP 1 156 505 A1. According to the measurement curve 2 in FIG. 3, 20 percent of the lamps had failed after 2500 operating hours, while in the case of the lamps according to the measurement curve 3 in FIG. 3, 20 percent of these lamps had already failed after only 1200 operating hours. The lamps which had been provided with the molybdenum films according to the invention in contrast did not fail even once within an operating time of 3000 hours, as can be seen from measurement curve 4 in FIG. 3. In particular, it was only in the case of the lamps with the molybdenum films according to the invention in which it was not possible to see any evidence of film lifting after 3000 operating hours.

Figure 4:
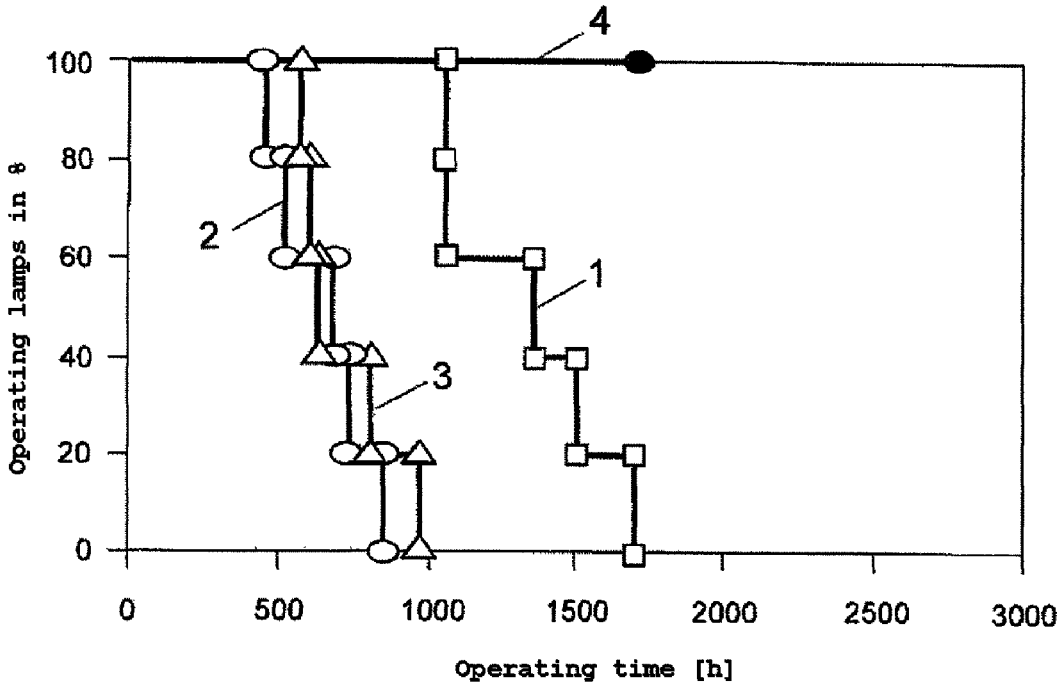
FIG. 4 shows the percentage component of the still functional, tested, mercury-free halogen metal-vapor high-pressure discharge lamps over the operating time of the high-pressure discharge lamps.

FIG. 4 shows the result of a special fast-switching test on a large number of mercury-free halogen metal-vapor high-pressure discharge lamps designed according to the example illustrated in FIG. 1, but which have been provided with different molybdenum films. The lamps according to the measurement curve 1 in FIG. 4 were provided with molybdenum films which had been sand-blasted according to the prior art. 40 percent of these lamps had already failed after about 1100 operating hours, and only 20 percent of these lamps were still functional after 1500 operating hours, and all of the lamps with uncoated molybdenum films had failed after 1700 operating hours. The lamps according to measurement curves 2 and 3 in FIG. 4 were provided with molybdenum films which have a coating according to EP 1 156 505 A1. According to the respective measurement curves 2 and 3 in FIG. 4, all of the lamps whose molybdenum films had a coating according to EP 1 156 505 A1 had failed after only 800 operating hours and 950 operating hours, respectively.

In contrast, those mercury-free high-pressure discharge lamps which had been provided with the molybdenum films according to the invention do not produce a single failure within an operating time of 1800 hours, as can be seen from the measurement curve 4 in FIG. 4. In particular, no evidence of film lifting could be seen at all after 1800 operating hours in the lamps with the molybdenum films according to the invention.

The abovementioned lamp failures were all caused by separation of the molybdenum films from the quartz glass of the discharge vessel.

The measurement results illustrated in FIGS. 3 and 4 were achieved on high-pressure discharge lamps with molybdenum films which had been manufactured and treated according to the first and the second exemplary embodiments as described above.

The invention is not restricted to exemplary embodiments explained in more detail above. In particular, the molybdenum film according to the invention can also be used for other lamp types, for example for electrical supply through halogen incandescent lamp vessels that are sealed in a gas-tight manner. The dimensions of the molybdenum film need to be matched to the application. In particular, the thickness D and the width B of the molybdenum film 21 must be matched to the electrical power consumption of the lamp, and to the maximum lamp current level. The mixture ratio of aluminum oxide to titanium oxide is not restricted to the two exemplary embodiments, but can be varied. It should preferably be chosen such that the amount of the deposits on the surface of the molybdenum film does not become so great as to adversely affect the weldability to the electrical supply and the electrode. Instead of titanium oxide, it is also possible to use the oxides mentioned above and ruthenium as further component, in addition to aluminum oxide in the sandblasting means. Furthermore, some of all of the aluminum oxide can be replaced by quartz sand, as a result of which the main component of the sandblasting means is no longer formed from aluminum oxide but, instead of this, from quartz sand or from a mixture of quartz sand and aluminum oxide.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A method for producing a molybdenum film for lamp construction, the method comprising:

roughening at least a part of the molybdenum film by a sandblasting means, wherein the sandblasting means contains titanium oxide and at least one of aluminum oxide and quartz sand, wherein the proportion by weight of the at least one of aluminum oxide and quartz sand in the sandblasting means is greater than 99 percent by weight, and the proportion by weight of the titanium oxide in the sandblasting means is less than 1 percent by weight, and wherein the mean particle size of titanium oxide is less than or equal to 1 micrometer and the mean particle size of that component of the sandblasting means which is formed by at least one of aluminum oxide and quartz sand is less than or equal to 100 micrometers.

* * * * *